US006813919B1

(12) United States Patent
Ellis

(10) Patent No.: US 6,813,919 B1
(45) Date of Patent: Nov. 9, 2004

(54) METHOD OF MAKING A FRAME MEMBER INTO U-SECTION AND C-SECTION PANEL PROFILES

(75) Inventor: Philip George Ellis, Auckland (NZ)

(73) Assignee: IBS Group Limited, Auckland (NZ)

( * ) Notice: Subject to any disclaimer, the term of this patent is extended or adjusted under 35 U.S.C. 154(b) by 0 days.

(21) Appl. No.: 09/786,739

(22) PCT Filed: Sep. 7, 1999

(86) PCT No.: PCT/NZ99/00149

§ 371 (c)(1),
(2), (4) Date: Oct. 15, 2001

(87) PCT Pub. No.: WO00/14355

PCT Pub. Date: Mar. 16, 2000

(30) Foreign Application Priority Data

Sep. 8, 1998 (NZ) ..... 331788

(51) Int. Cl.[7] ..... B21D 5/08
(52) U.S. Cl. ..... 72/7.1; 72/181
(58) Field of Search ..... 72/181, 7.1, 6.2, 72/6.1; 29/428; 52/745.19

(56) References Cited

U.S. PATENT DOCUMENTS

| | | | | | |
|---|---|---|---|---|---|
| 164,567 | A | * | 6/1875 | Laing | 72/181 |
| 3,462,989 | A | * | 8/1969 | Fischer, Jr. | 72/178 |
| 4,716,754 | A | * | 1/1988 | Youngs | 72/178 |
| 5,259,871 | A | * | 11/1993 | Tigerholm | 96/161 |
| 5,359,871 | A | * | 11/1994 | Morello | 72/8.3 |
| 5,970,769 | A | * | 10/1999 | Lipari | 72/131 |
| 6,185,476 | B1 | * | 2/2001 | Sakai | 700/182 |
| 6,397,453 | B1 | * | 6/2002 | McGlinchy et al. | 72/181 |

FOREIGN PATENT DOCUMENTS

| | | |
|---|---|---|
| AU | 494278 | 6/1978 |
| AU | 6213780 | 3/1981 |
| AU | 627358 | 8/1992 |
| AU | 5266593 | 10/1994 |
| GB | 1468190 | 3/1977 |
| GB | 2061788 A | 5/1981 |
| GB | 2169937 | 7/1986 |
| WO | 8701977 | 4/1987 |
| WO | 9826884 | 6/1998 |

* cited by examiner

*Primary Examiner*—Daniel C. Crane
(74) *Attorney, Agent, or Firm*—Baker Botts LLP; Manu J. Tejwani

(57) ABSTRACT

This invention relates to metal framing (2, 3, 4), in particular steel framing for building construction. The invention also relates to a method of constructing a metal frame assembly (2, 3, 4) and roll forming apparatus (41) for producing metal framing for building construction. The individual components of the metal frame (2, 3, 4), and assembly made from these components is adapted to provide for a substantially even planar surface without deformations, to which a cladding may be attached with a preferred even finish. The invention also includes roll forming apparatus (41) adapted for producing metal framing (2, 3, 4) of this type, and particularly adapted to produce metal frame members (2, 3, 4) having a predominantly C-section profile (7), with one or more portions of a U-section profile (9, 6), the U-section (9, 6) and C-section (7) profiles formed simultaneously on the same sheet metal strip (43). The apparatus (41) is also adapted to form narrowing or swaging of the channel at same or all U-section portions (6). The overall method of constructing a building frame assembly of the invention includes recording data defining a unit area in which a frame assembly is to fit, processing the data to design a frame assembly to fit that unit area, and controlling operation of roll forming apparatus (41) by a computing means using the processed data, to produce frame members (2, 3, 4) cut and formed ready for assembly to produce the required design of frame assembly.

7 Claims, 6 Drawing Sheets

METHOD OF MAKING A FRAME MEMBER INTO U-SECTION AND C-SECTION PANEL PROFILES

FIELD OF INVENTION

This invention relates to metal framing, in particular steel framing, for building construction. The invention also relates to a method of constructing a metal frame assembly and apparatus for producing metal framing for building construction.

BACKGROUND OF INVENTION

The high costs of timber have made the use of steel framing in building construction cost effective. Known forms of steel frame construction require the riveting together of frame members which make up the studs and nogs of the frame. Since the frame members generally have a C-section it is necessary to bend back the lip at various points along a stud where a nog is to be interconnected. This bending out or flattening of the lip can introduce bending or deformation of the frame member. Furthermore, because all components of a frame are made from members of the same cross-section, the required overlapping of members when a nog is inserted between the sides of a stud results in localised deformation of the stud. Any deformations in the sides of the frame members results in an uneven planar surface of the frame with consequential difficulties in affixing a cladding to the frame with a preferred even finish.

A further limitation associated with conventional methods of constructing steel framing for building relates to the fact that the framing is manufactured off site in standard lengths. The construction of a frame from such preformed lengths at a construction site is labour intensive and therefore costly. Each standard piece has to be manually cut, punched and assembled on site.

It is an object of the present invention to provide a method of manufacture of a metal frame section for building construction and/or a method of constructing a metal frame assembly for building construction and/or apparatus for forming metal frame sections, which reduces or over comes the abovementioned problems, or which at least provides the public with a useful alternative.

Other objects of the invention may become apparent from the following description which is given by way of example only.

SUMMARY OF INVENTION

According to one aspect of the present invention there is provided roll forming apparatus adapted to form, from sheet metal strip, metal frame members for use in building construction, said apparatus including lip forming members engageable to convert a roll-formed U-section channel profile to a C-section channel profile, and said apparatus adapted to form the said U-section and C-section channel profiles simultaneously on the same sheet metal strip.

Preferably, the roll forming apparatus may further be adapted to roll form different widths of channel profile at selected regions during a continuous roll forming operation.

Preferably the apparatus may further include a moveable operational unit including one or more functional components.

Preferably the apparatus may further include computing means adapted to control and synchronise roll forming, lip-forming, groove-forming and the operational unit.

According to a further aspect of the present invention there is provided a method of constructing a building frame assembly said method including the steps of:

recording data defining a unit area in which the frame assembly is to fit, processing the data on computing means to design the frame assembly to fit the unit area, controlling operation of roll forming apparatus adapted to form channel-shaped metal frame members from sheet metal strip, using the processed data from the computing means, to produce frame members cut and formed ready for assembly to produce the required design of frame assembly.

According to a further aspect of the present invention there is provided a frame assembly for use in building construction, the assembly including a plurality of metal frame members, portions of selected frame members having a U-section channel profile swaged or narrowed portion adapted to engage within the sides of a U-section channel profile of another frame member substantially without deforming the profile of the other frame member.

Preferably, the frame assembly may include a plurality of first metal frame members forming studs and a plurality of second metal frame members forming nogs.

According to a further aspect of the invention there is provided a method of constructing a metal frame member from a sheet metal strip on roll forming apparatus, the method including forming U-section and C-section channel profiles simultaneously on the same sheet metal strip.

Other aspects of the present invention may become apparent from the following description which is given by way of example only and with reference to the accompanying drawings.

DETAILED DESCRIPTION OF INVENTION

This invention has several aspects all directed towards the efficient construction of metal frame assemblies. Hereafter, such assemblies and their components are referred to as steel frame members or assemblies since steel is the current metal of choice. However, it will be appreciated that other metals or alloys may be used.

The first aspect of the invention relates to a method of construction of steel frame members in a form which facilitates assembly of the frame and which enables a frame to be produced with substantially planar surfaces. This is achieved by using roll forming apparatus to produce the steel frame channel members with a U-cross-section and forming this into a C-cross-section only at portions between or free from intended junctions. It is further facilitated by including one or more longitudinal ridges or slots in the base of the channel and increasing the depth of the or each ridge at regions which will need to be engaged within an interconnecting section. Increasing the depth of the ridge narrows or swages that region so that, for example, a swaged frame member end may engage within the C-section of another unit without splaying the sides of that other unit (see FIG. 2); or a swaged portion of a frame member may be adapted to engage with an end of another unit whilst retaining a substantially even planner outer surface (see FIG. 4).

Figure 1:
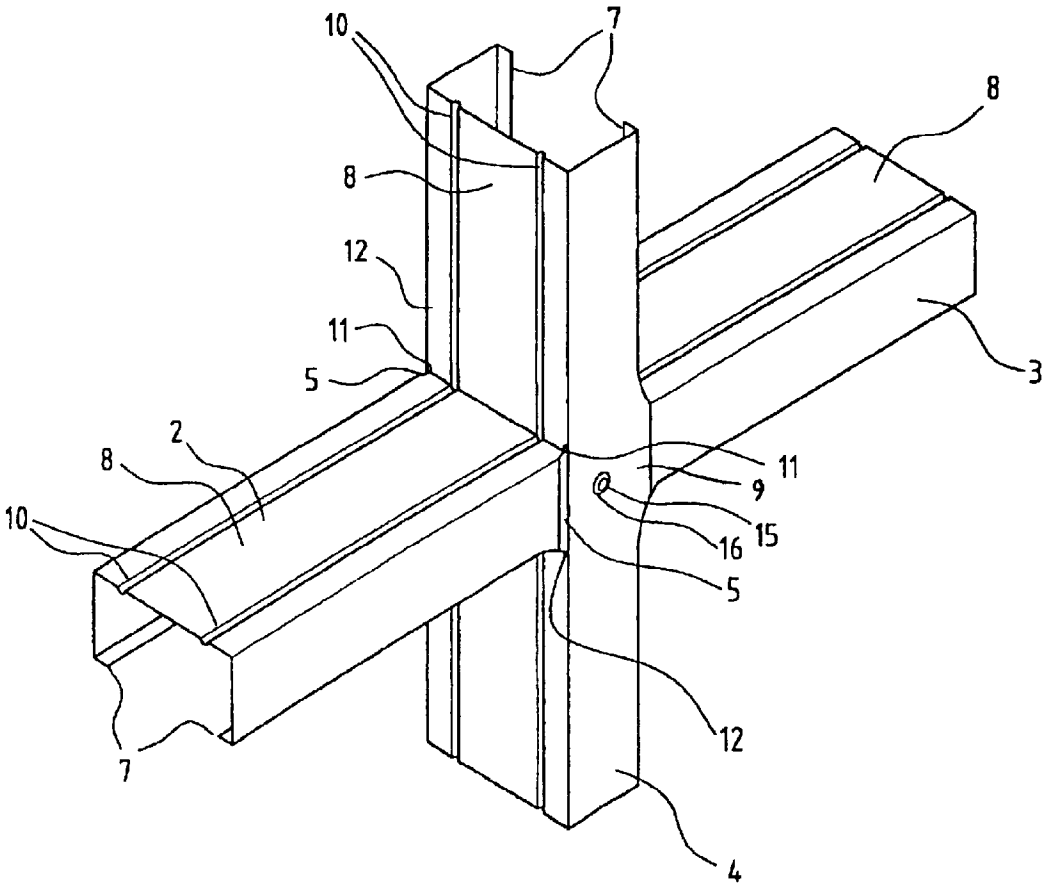
FIG. 1 shows a perspective view of a junction between nogs and a stud of a metal frame assembly of the present invention, in one form.

FIG. 1 shows an interconnection between nogs 2, 3 and a stud 4 in an assembly of the present invention in one form.

At the region of interconnection 9 the stud 4 and ends 5, 6 of the nogs 2, 3 have a U-shaped cross-section. At intermediate points they have a C-shaped cross-section, with rolled-over lip edges 7. In the base 8 of each frame member there are longitudinal ridges 10.

The end 6 of nog 3 is swaged or narrowed slightly to engage neatly within the U-shaped part 9 of the stud 4. This is more readily apparent from FIGS. 2 and 3.

Figure 3:
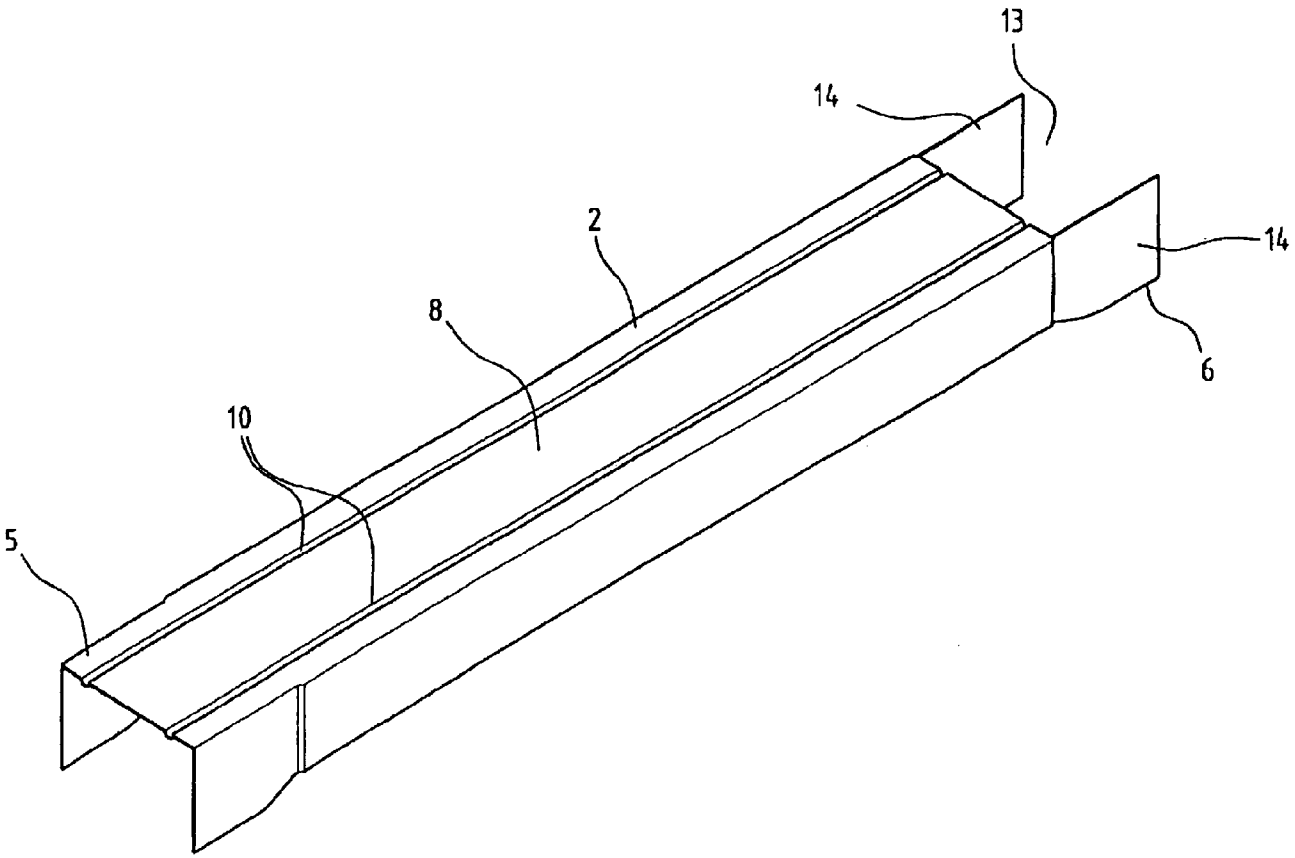
FIG. 3 shows a nog of an assembly of the invention in one preferred form.

Slots 11 may be formed in the edges 12 of the base of the stud 4 at the region of intended interconnection with a nog. With reference to FIG. 3, nog 2 has an end portion 13 of the base cut away, leaving side portions 14 extending beyond the end of the U-section. These side portions 14 are narrowed or swaged in relation to the remainder of the section in order to engage neatly through the slots 11 in the stud.

Figure 4:
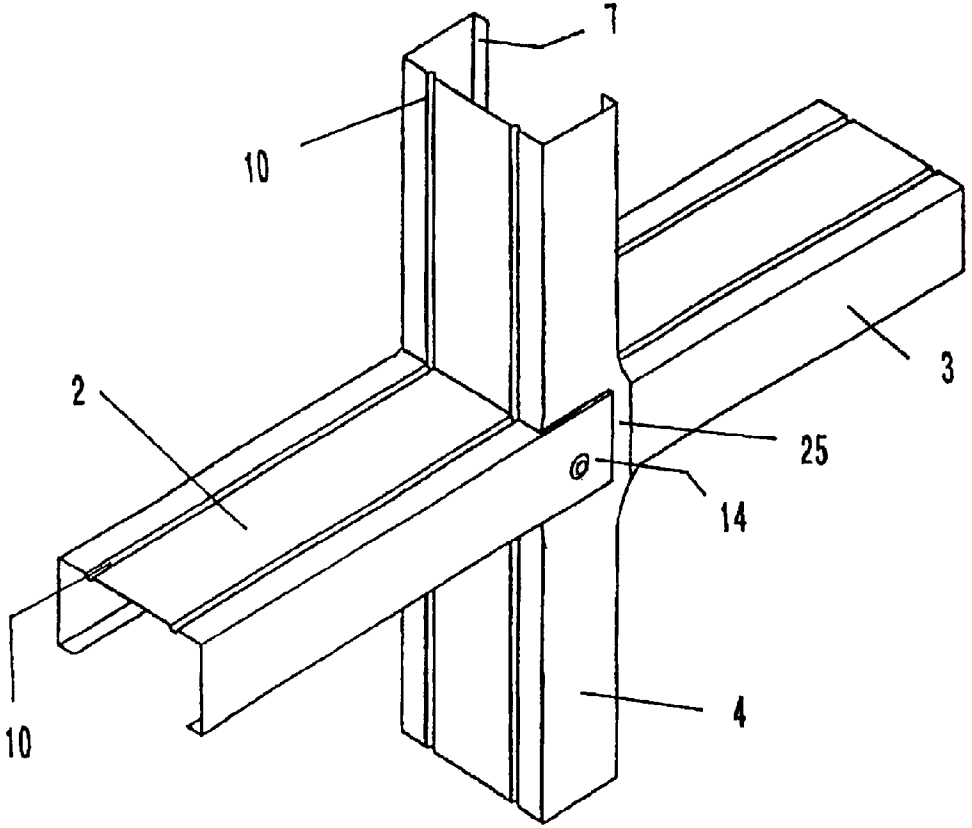
FIG. 4 shows a perspective view of a junction between nogs and a stud of a metal frame assembly of the invention in an alternative preferred form.

In an alternative configuration, with reference to FIG. 4, and to avoid the need for forming lateral slots in the stud, the stud may be swaged or narrowed at the regions of intended connection with nogs. The end of a nog 2 having the cut-away base and extending side portions 14 would not then be swaged, but the side portions 14 would rather engage about the outside of the swaged portion 25 of the stud 4. The nog 3 on the other side of the stud 4, if any, would still have a swaged portion adapted to engage within the stud channel. FIG. 4 shows an assembly in this configuration.

Holes may have been prepunched through the sides of the stud and nogs to receive rivets 15 which securely engage the components of the assembly together. Recesses or dimples 16 may also be preformed in the outer surface of the stud, about the punched hole so that a rivet head is recessed or substantially flush with the stud side surface.

With this design of assembly there is no deformation of the sides of the stud at the regions of interconnection with nogs, ensuring that cladding applied to the surface of a constructed frame will have an even finish.

Figure 2:
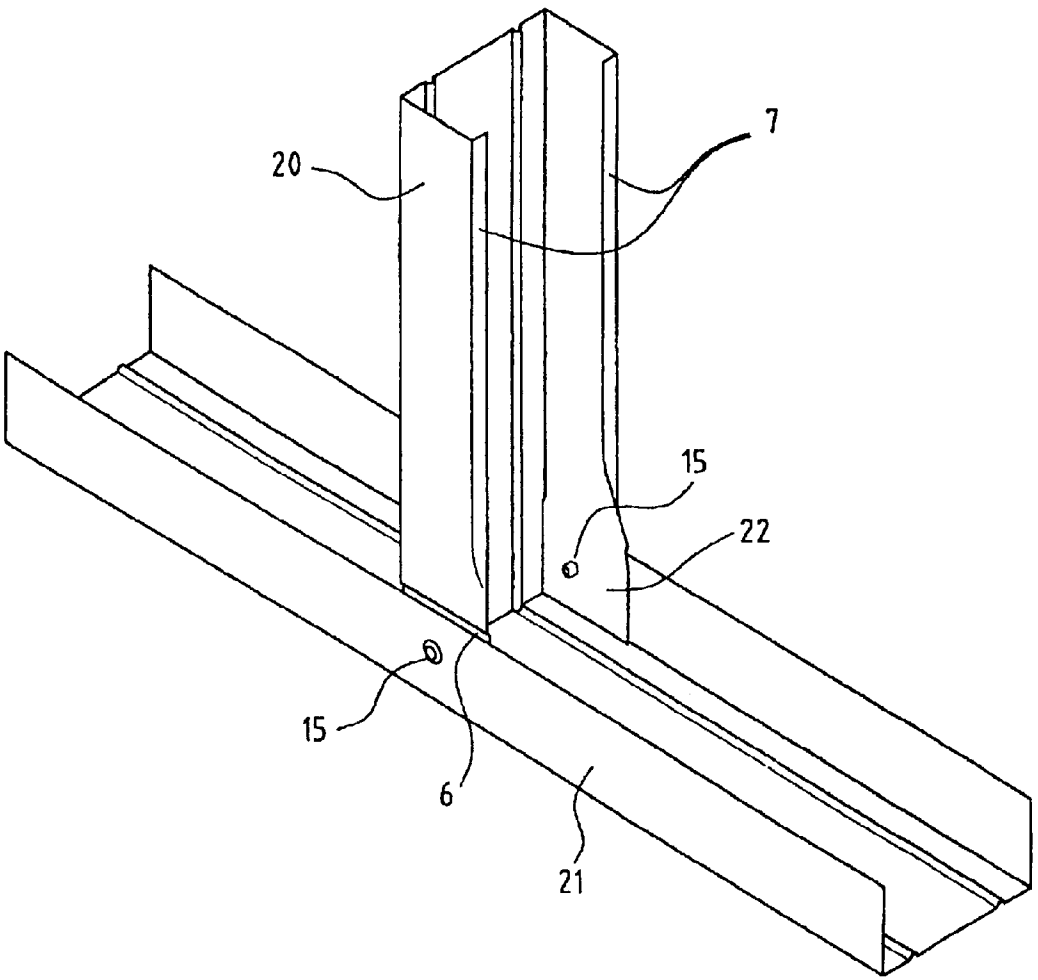
FIG. 2 shows a junction between an end of a stud and a base plate, or an end of a nog and a stud, of a metal frame assembly of the present invention.

FIG. 2 shows the connection between the bottom of a stud 20 and a base plate 21, although this could equally represent interconnection of the nog 3 of FIG. 1 into its stud 2. It can be seen that the base plate 21 differs from the stud 20 primarily in having a C-section along its entire length, there being no requirement for the strengthening achieved by rolling to form a C-section. The U-section end 22 of the stud 20 is narrowed or swaged to engage within the base plate 21 without deforming the sides of the base plate.

The narrowing or swaging of ends of frame members is achieved in the process of manufacturing each section by increasing the depth of the ridges 10.

A second main aspect of the invention relates to the method by which the individual components of a required frame assembly are manufactured. This is achieved by use of roll forming apparatus adapted to produce frame members of the desired configuration from galvanised flat steel in coil form. The roll forming apparatus may be portable so as to be located at a construction site. Alternatively, the roll forming apparatus may be located at a central manufacturing site, with information for specific jobs downloaded directly to the apparatus.

Figure 5:
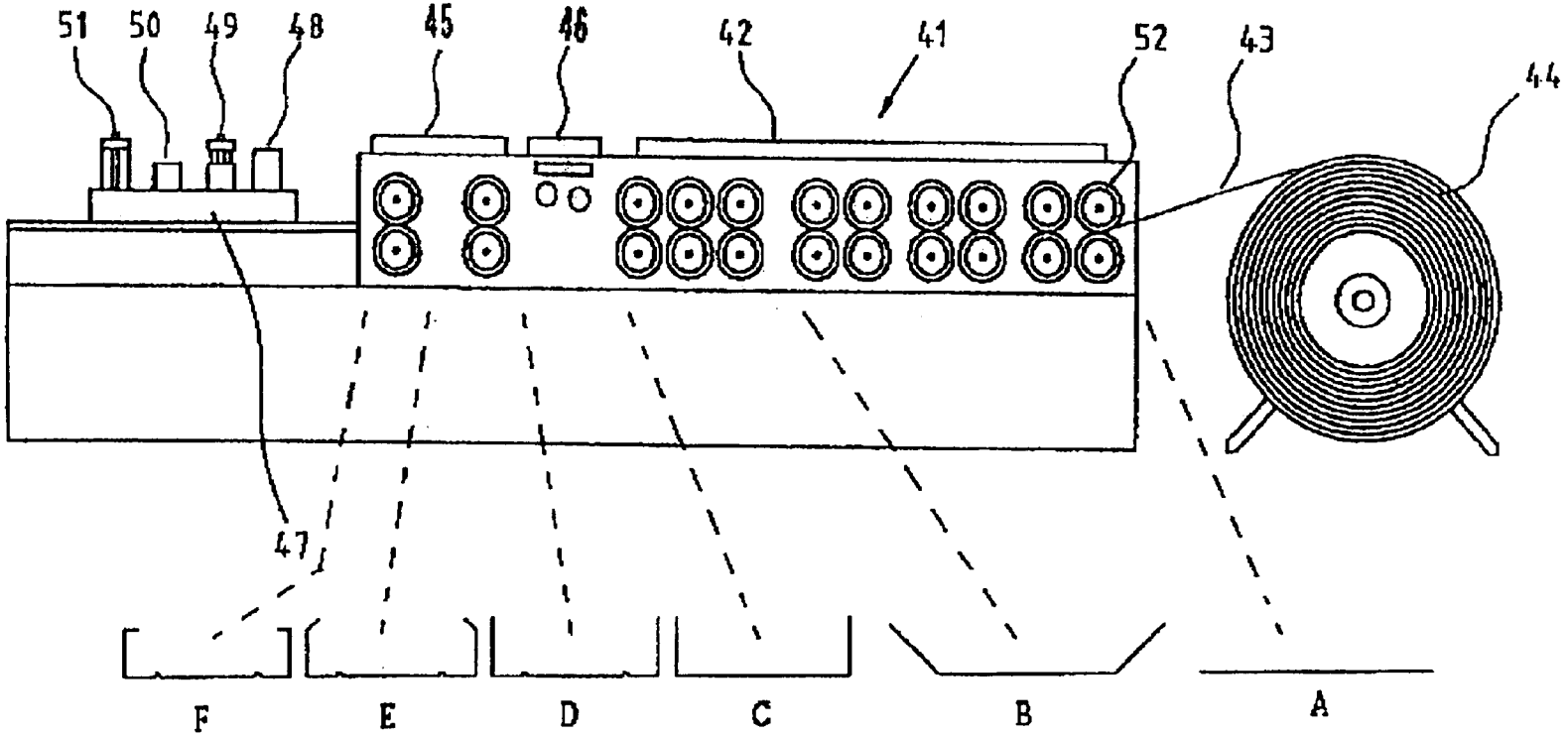
FIG. 5 shows a schematic representation of roll forming apparatus of the present invention in one preferred form.

With reference to FIG. 5, the roll former 41 includes a fist set of rollers 42 adapted to convert the flat steel 43 from the coil 44 into a U-shaped channel. Lip rollers 45 are provided to convert parts of the U-shaped channel into a C-section. Swage rollers 46 introduce the ridges in the base of the channel, and are adapted to control the depth of the ridges.

The apparatus may include two sets of lip rollers, the first to form a lip at substantially 45° and the second to continue the lip to substantially 90°, in relation to the channel sides.

FIG. 5 shows the progressive change in profile of the flat steel 43 as it moves through the roll forming apparatus. As shown by the profile marked "A," the steel is flat, and travels through a first set of rollers 42 in order to form a U-section profile "C." An intermediate profile "B" has been included to show the progressive change in profile from flat to a U-section profile. The swage rollers 46 introduce the ridges to form a profile marked as "D." Next, a first sub-set of rollers in the lip rollers 45 form a 45 degree lip to produce a profile marked as "E." Finally, the second subset of rollers in the lip rollers 45 output a C-section profile marked "F."

A moving tool bed or operational unit 47 is provided. This servo-controlled tool bed may include a slitter 48 for producing slits in the sides of the base of the channel at the regions of intended interconnection, a service hole punch 49 adapted for producing holes for electrical wires, plumbing pipes and the like, a notcher 50 for removing a section of the base of the channel which then leaves protruding side portions of a nog for engagement in a stud, and a guillotine and hole punch unit 51 for punching and optionally countersinking rivet holes and guillotining each frame member to length. The servo-controlled system enables these functions to be carried out during continuous feed of the steel through the apparatus. It will be appreciated that more or less features may be included on the servo table; for example the slitter may be omitted.

At least one set of the first rollers 42 may be knurling rollers 53 adapted to form textured outer sides of the U-channel. The knurling of the sides of the channel assists in preventing screws from slipping when applying a cladding such as gypsum plasterboard to a completed assembly.

The roll forming apparatus 41 is adapted to produce U-shaped and C-shaped section simultaneously by control of the lip rolling function. This enables framing sections to be produced which do not require flattening of lip portions to enable interconnection of the end of one member within the channel of another. Similarly, the swaging or narrowing of profile at desired regions can be achieved within the single roll former in a continuous operation.

The roll forming apparatus is controlled by computing means.

The roll forming apparatus may be driven by hydraulic motor or alternatively by an electric motor. It is preferably adapted to roll from 0.4 to 1.2 millimetre gauge steel or galvanised steel.

Optionally, the roll former may also include a straightening station, comprising vertically disposed pairs of rollers about each side wall for lateral straightness and a pair of horizontally disposed rollers for vertical straightness, to ensure that each frame member is straight. Flat steel in coil form is not always straight, and this can result in bends or warps in individual lengths of building elements.

Figure 6:
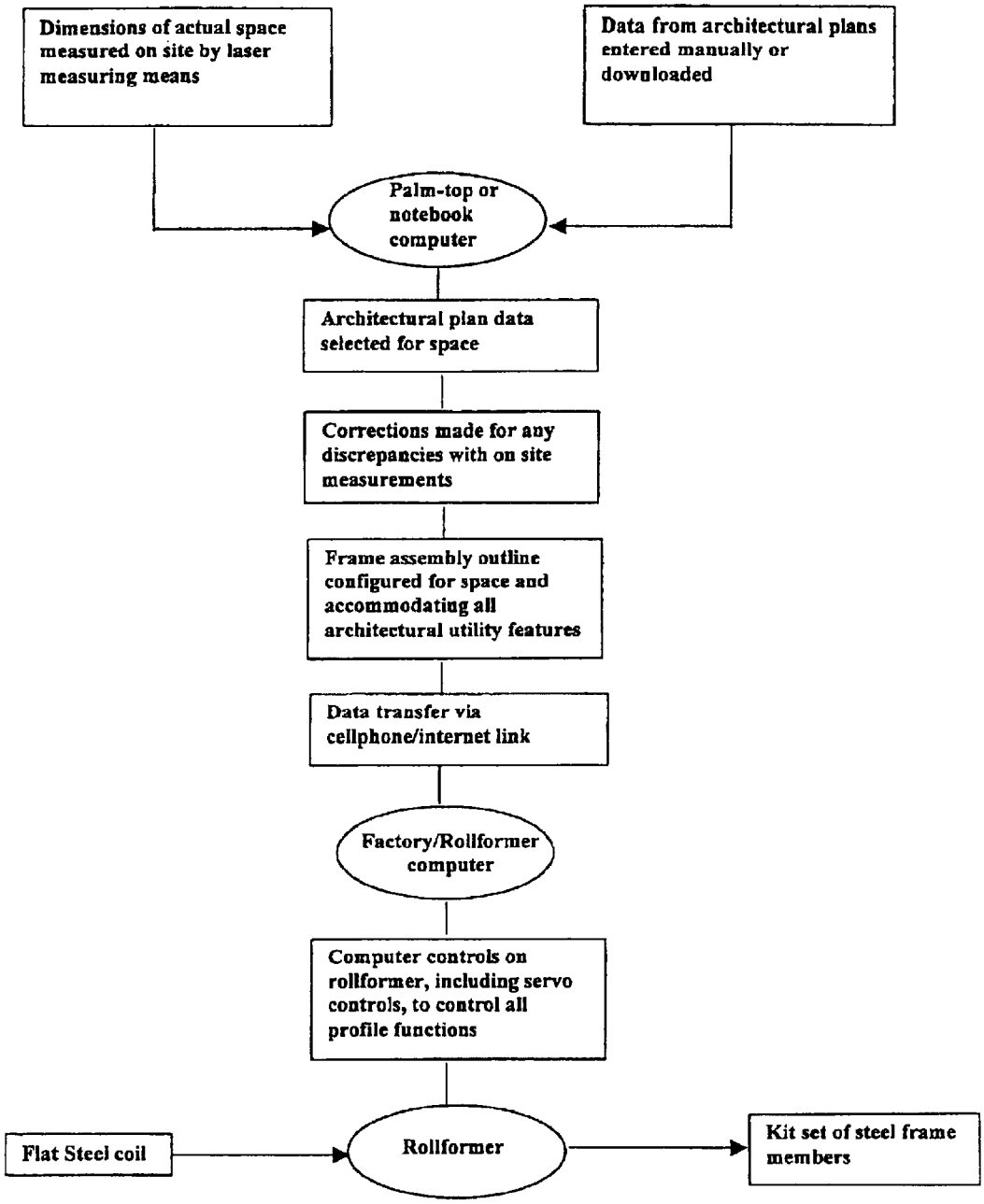
FIG. 6 is a flow diagram of the steps involved in a method of the invention for producing a metal frame assembly.

A preferred method of producing a building frame assembly of the invention is now described with reference to FIG. 6.

The measurements of a space for which a frame assembly is required is taken on site manually, or automatically by a laser measuring device. This data is entered into a computing means such as a palm-top or notebook computer. Also loaded into the computer are details from the architectural plans. Where architectural plans are available in electronic form, the on site data is used for verification.

The data is processed using specific software to generate a required frame design for that space. This design will include not only the dimensions of the space but also the locations and dimensions of architectural and other features required to be accommodated in the space, such as windows, doors, air-conditioning ducts, electrical sockets and switches and the like. The frame assembly outline is then downloaded via millimeter or an internet link, for example, to the factory site where the rollformer is located. The rollformer computer controls all operations of the rollformer to produce the frame mebers required for the frame assembly. Thus, the length and configuration or form of each frame member for this frame assembly are calculated by the computer, which in turn controls operation of the roll former to form each required frame member from the flat steel coil in a substantially continuous operation.

Thus, by employing the method of the present invention involving the roll forming apparatus described, customised frame assemblies to fit spaces having specified design characteristics can be manufactured and constructed conveniently and efficiently. Effectively a kit set of frame members is provided for each required building frame assembly. This avoids the problems associated with the use of standard preformed steel frame members which must be manually cut, punched and forced together in a manner which often results in the deformation of the smooth surfaces to which cladding must be applied.

Where in the foregoing description reference has been made to specific components or integers of the invention having known equivalents then such equivalents are herein incorporated as if individually set forth.

Although this invention has been described by way of example and with reference to possible embodiments thereof it is to be understood that modifications or improvements may be made thereto without departing from the scope or spirit of the invention.

What is claimed:

1. A method of constructing a first metal frame member from a sheet of metal strip on a roll forming apparatus, the method including the step of forming at least one first portion of the first metal frame member having a U-section channel profile and the step of forming at least one second portion of the first metal frame member having a C-section channel profile, wherein the at least one first portion and the at least one second portion are formed on the same sheet of metal strip that is fed into the roll forming apparatus for processing, and wherein the steps are performed in manner such that the processed first metal frame member output from the roll forming apparatus has distinct first and second portions that respectively have U-section and C-section channel profiles.

2. The method of claim 1, further comprising, the step of swaging a portion of the channel by forming one or more ridges in a base portion of the U-section and the C-section channel profiles, the one or more ridges formed at a predetermined depth to achieve a desired amount of swaging.

3. The method of claim 2, wherein the step of forming the one or more ridges further comprises the substeps of forming a first ridge having a first depth and subsequently increasing the depth of the first ridge to form a second ridge having a second depth which is greater than the first depth.

4. The method of claim 1, wherein the step of forming the U-section channel profile comprises the substep of forming the U-section channel profile only in portions of the sheet metal strip where the first metal frame member is designed to form a junction with a second metal frame member.

5. A method of constructing a building frame assembly, said method including the steps of:

recording data defining a unit area in which the frame assembly is to fit;

processing the data on computing means to design the frame assembly to fit the unit area; and conducting the steps of forming at least one first portion of a first frame member into a U-shaped profile and forming at least one second portion of the first frame member into a C-shaped profile by using the processed data from the computing means to control a roll forming apparatus which is adapted to form the at least one first portion of the first frame member and the at least one second portion of the first frame member from a single sheet metal strip that is fed into the roll forming apparatus for processing, and wherein the steps of forming are conducted in manner such that the processed first metal frame member output from the roll forming apparatus has distinct first and second portions that respectively have U-section and C-section channel profiles.

6. The method of claim 5, wherein the data defining the unit area includes data from architectural/design drawings, such that the frame assembly is adapted to accommodate all utility and architectural features required in the unit area.

7. The method of claim 6, wherein the data further includes physical measurements of actual dimensions of the unit area.

* * * * *

UNITED STATES PATENT AND TRADEMARK OFFICE

CERTIFICATE OF CORRECTION

PATENT NO. : 6,813,919 B1
DATED : November 9, 2004
INVENTOR(S) : Philip George Ellis It is certified that error appears in the above-identified patent and that said Letters Patent is hereby corrected as shown below:

Title page,
Item [73], Assignee, should read -- FrameMax, Inc., Riverside, California --.

Signed and Sealed this

Twenty-third Day of August, 2005

JON W. DUDAS
*Director of the United States Patent and Trademark Office*